US005421919A

United States Patent [19]

Roman et al.

[11] Patent Number: 5,421,919

[45] Date of Patent: Jun. 6, 1995

[54] METHOD FOR FORMING A WEAR AND CORROSION RESISTANT METALLIC FINISH ON A SUBSTRATE

[75] Inventors: Jean-Marie Roman, Echirolles; Jean-Marie Dubois, Pompey; Philippe Plaindoux, Volkrange; Jean-Pierre Houin, Vandeuvre, all of France

[73] Assignee: Neypric, Grenoble, France

[21] Appl. No.: 251,947

[22] Filed: Jun. 1, 1994

Related U.S. Application Data

[62] Division of Ser. No. 60,985, May 14, 1993, Pat. No. 5,376,191.

[30] Foreign Application Priority Data

May 22, 1992 [FR] France ..... 92 06535

[51] Int. Cl.[6] ..... C21D 1/68; C23C 4/08

[52] U.S. Cl. ..... 148/517; 148/537; 427/456

[58] Field of Search ..... 148/517, 537, 403; 427/456

[56] References Cited

U.S. PATENT DOCUMENTS 4,668,310 5/1987 Kudo et al. ..... 148/403
4,863,526 9/1989 Miyagawa et al. .

FOREIGN PATENT DOCUMENTS 0223135 5/1987 European Pat. Off. .
0224724 6/1987 European Pat. Off. .
0271657 6/1988 European Pat. Off. .
56-116854 9/1981 Japan ..... 148/403
58-27941 2/1983 Japan .
63-306508 12/1988 Japan .

OTHER PUBLICATIONS

JP-A-58-136755, Aug. 1983, English Language Abstract.

*Primary Examiner*—Deborah Yee
*Attorney, Agent, or Firm*—Dowell & Dowell

[57] ABSTRACT

The finishes of the present invention consist essentially of metal alloys having the general formula:

$$T_aCr_bZr_cB_dM_eM'_fX_gI_h \quad (I)$$

in which a+b+c+d+e+f+g+h =100 atomic percent;

T is Ni, Co, Ni—Co or any combination of at least one of Ni and Co with Fe, wherein $3<Fe<82$ at. % and $3<a<85$ at. %;

M is one or more elements of the group consisting of Mn, Cu, V, Ti, Mo, Ru, Hf, Ta, W, Nb, Rh, wherein $0<e<12$ at. %;

M′ is one or more rare earths, including Y, wherein $0<f<4$ at. %;

X is one or more metalloids of the group consisting of C, P, Ge and Si, wherein $0<g<17$ at. %;

I represents inevitable impurities, wherein $h<1$ at. %, and $5\leqq b\leqq 25$, $5\leqq c\leqq 15$, and $5\leqq d\leqq 18$.

Powders obtained from these alloys that are deposited on substrates by thermal projection provide finishes having increased hardness in addition to high ductility and excellent resistance to corrosion. The finishes are suited for applications including hydraulic equipment.

29 Claims, 3 Drawing Sheets

METHOD FOR FORMING A WEAR AND CORROSION RESISTANT METALLIC FINISH ON A SUBSTRATE

RELATED APPLICATIONS

This application is a divisional of U.S. patent application Ser. No. 08/060,985, filed on May 14, 1993, now U.S. Pat. No. 5,376,191 and entitled "Amorphous Alloy-Based Metallic Finishes Having Wear and Corrosion Resistance, and Processes for Obtaining Same."

BACKGROUND OF THE INVENTION

This invention relates to amorphous alloy-based metallic finishes which are resistant to wear and corrosion, processes for obtaining these finishes, and suitable applications for using these finishes to provide anti-wear surfaces, and particularly in hydraulic equipment.

In the following description, these metallic finishes will be primarily described by reference to their applications onto metal substrates. It is, however, within the scope of the present invention to apply these metallic finishes to non-metal substrates such as wood, paper, synthetic substrates and the like.

Solutions are being sought in numerous fields to overcome the problems associated with wear due to abrasive erosion, scoring and friction in aggressive surroundings, and cavitation. These particular problems are especially severe in hydraulic equipment such as turbines.

The materials presently being used are generally hard, but they are fragile and accordingly their users are seeking materials which provide the following improved combination of properties: (1) increased hardness to resist the harmful effects of erosion, friction and scoring; (2) high ductility to resist shocks and minor deformations; and (3) homogeneous structures to assure uniform high corrosion resistance.

The materials which are presently available, such as steels having high mechanical properties, stellite, ceramics, and the like, do not have all these properties. In particular, those materials having high corrosion resistance have insufficient mechanical properties.

One of the solutions so far for obtaining materials having a satisfactory compromise of these contradictory properties has been metal alloys having amorphous structures that have been obtained by rapid cooling techniques.

The amorphous alloys that have so far been used are essentially in the form of thin strips obtained by casting methods or very thin deposits obtained by electrochemical methods.

The thermal projection methods and, for example, the arc-blown plasma method, have not yet enabled the obtaining of completely amorphous alloys at the level of X-ray diffraction in the form of thick (i.e., >0.5 mm) powder deposits on surfaces as large as several square meters.

Among the various known amorphous alloys are the iron-based metal/metalloid alloys (Fe—B or Fe—Cr—P—B alloys) which have provided the best mechanical properties. However, none of these alloys have satisfied the contradictory requirements of increased mechanical resistance, corrosion resistance and high ductility.

SUMMARY OF THE INVENTION

The object of the present invention is to provide amorphous metallic finishes which combine, with increased mechanical characteristics, a certain ductility, an increased crystallization temperature, high capacity to have residual manufacturing stresses removed by thermal treatments without producing a noticeable change in the structure and ductility of the finishes, and high resistance to corrosion, including exposure to the halogens. The present finishes can be obtained from alloys which can be formed at cooling rates of about $10^5$ K/s, and it is possible to obtain these finishes for thicknesses of from 0.03 mm to 1.5 mm on large surfaces.

Amorphous finishes in accordance with the present invention can be obtained by combining different ratios of certain constituent elements with base constituent elements and, in particular, by combining B and Zr with an Fe—Ni and/or Co matrix.

Moreover, a low metalloid concentration and the absence of intermetallic compounds with a high melting point allows attaining a satisfactory ductility. The presence of zirconium allows attaining a higher crystallization temperature. Finally, an appropriate addition of Cr and Zr provides resistance against corrosion.

The amorphous metallic finishes of the invention are characterized as being resistant to wear and corrosion, and consist essentially of alloys having the following general formula:

$$T_aCr_bZr_cB_dM_eM'_fX_gI_h \quad (I)$$

in which a+b+c+d+e+f+g+h=100 atomic percent.

T is Ni, Co, Ni—Co, or any combination of at least one of Ni and Co with Fe, wherein 3<Fe<82 at. % and 3<a<85 at. %.

M is one or more of the elements of the group consisting of: Mn, Cu, V, Ti, Mo, Ru, Hf, Ta, W, Nb and Rh, wherein 0<e<12 at. %.

M' is one or more of the rare earths, including Y, wherein 0<f<4 at. %.

X is one or more of the metalloids of the group consisting of C, P, Ge and Si, wherein 0<g<17 at. %.

I represents inevitable impurities, wherein h<1 at. %.

In addition, $5 \leqq b \leqq 25$, $5 \leqq c \leqq 15$, and $5 \leqq d < 18$.

The powders of these alloys are obtained by atomization and, for grain sizes of less than 100 μm, the grains have a completely amorphous structure as determined by X-ray diffraction.

The deposition of the powders by thermal projection allows a reproducibility of both the nature of the deposits and the structure of the finishes.

The alloys used for the metallic amorphous finishes of the present invention are resistant to wear and erosion and have numerous advantages in relation to the alloys of the prior art. First, the present alloys easily form amorphous structures due to the simultaneous presence of boron, an element whose atomic size is less than that of the atoms of component T, and Zr, which is larger than the T component atoms.

The introduction of other elements such as the rare earths and/or the metalloids promotes the tendency of the alloys to form amorphous structures.

Moreover, the temperature of crystallization of the present alloys is significantly increased in comparison to the alloys of the prior art, such as the alloys of Fe—B, Fe—B—C, and Fe—B—Si. This effect can be attributed to the presence of zirconium, and can be further enhanced by the addition of refractory elements such as Mo, Ti, V, Nb, Rh and the like, or metalloids.

The combination of chromium and zirconium provides an excellent resistance to corrosion, which can be further enhanced by the addition of Rh, Nb, Ti, the rare earths and P.

Finally, the metallic glasses of the present invention are essentially ductile at an acceptably low metalloid concentration range, namely $b+g \leqq 24$ at. %. Thus, the present alloys satisfactorily resist embrittlement, which usually occurs in other alloys following thermal treatments conducted at the temperature of crystallization.

In the general formula (I) described above, the T component element can be varied to provide different alloy families which satisfy the aforementioned criteria of the present invention.

If T is nickel, the following general family of alloys (II) can be provided:

$$Ni_aCr_bZr_cB_dM_eM'_fX_gI_h \quad \text{(II)}$$

in which $a+b+c+d+e+f+g+h=100$ atomic percent.

M, M', X and I represent the same elements as those listed above with respect to formula (I), the compositions thereof being those described above.

Another general family of alloys (III) in accordance with the present invention consists of alloys as in family (II) in which a portion of the nickel atoms has been replaced by iron atoms, namely $$Ni_aFe_{a'}Cr_bZr_cB_dM_eM'_fX_gI_h \quad \text{(III)}$$

in which: $0 \leqq a+a' \leqq 85$ at. %. All the other symbols have the same meaning as described above.

Substituting a portion of the nickel atoms of the above family (II) with cobalt atoms provides alloys of the following general formula ( IV ):

$$Ni_aCo_{a''}Cr_bZr_cB_dM_eM'_fX_gI_h \quad \text{(IV)}$$

in which: $0 \leqq a+a'' \leqq 85$ at. %. The other symbols have the same meaning as in the formula (I).

A final family of alloys of the general formula (V) in which a portion of the nickel atoms has been replaced by iron and cobalt atoms can be written as follows:

$$Ni_aFe_{a'}Co_{a''}Cr_bZr_cB_dM_eM'_fX_gI_h \quad \text{(V)}$$

in which: $0 \leqq a+a'+a'' \leqq 85$ at. %.

DETAILED DESCRIPTION OF THE PREFERRED EMBODIMENT

Figure 1:
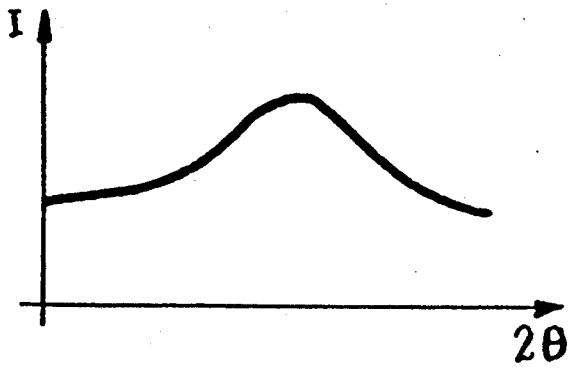
FIGS. 1 to 7 are x-ray diffraction curves in which the abscissa represents the value of the angle $2\theta$ and the ordinate represents the value of the intensity I.

The following examples are presented to illustrate various aspects of the present invention, including its characteristics and advantages.

EXAMPLE 1: PREPARATION OF ALLOYS OF THE FAMILY (II)

Alloys corresponding to the general formula of the family (II) were prepared in the liquid state from individual constituents. Elements of commercial purity were alloyed in the liquid state in a cold-shelf oven placed under a helium atmosphere. The alloys were introduced into an inductor of a band-casting machine consisting of a copper wheel having a 250 mm diameter and a tangential speed of 35 m/s. The enclosure containing the wheel was located in a helium atmosphere. The crucible was composed of quartz, and had an opening of 0.8 mm diameter. The injection pressure of the liquid metal was 0.5 bar. The temperature of the liquid metal was measured by an optical pyrometer at the top surface of the metal.

The concentrations, in atomic %, of the chemical elements were as follows:

| | |
|---|---|
| $50 \leqq Ni \leqq 75$ | $0 \leqq Mo \leqq 5$ |
| $5 \leqq Cr \leqq 25$ | $0 \leqq Hf \leqq 5$ |
| $5 \leqq Zr \leqq 15$ | $0 \leqq Si \leqq 5$ |
| $5 \leqq B \leqq 15$ | $0 \leqq La \leqq 4$ |

A more precise chemical analysis gave: $Ni_{58}$; $Cr_{20}$; $Zr_{10}$; $B_{10}$; $Mo_2$. This alloy had a fusion temperature ($Tf_0$), measured by an optical pyrometer, of 1127° C., and a hardness $Hv_{30}$ of 480.

EXAMPLE 2: PREPARATION OF ALLOYS OF THE FAMILY (III)

Alloys corresponding to the general formula of the family (III) were formed as bands in the identical manner as used to form the alloys of EXAMPLE 1.

The concentrations, in atomic %, of the chemical elements, were as follows:

| | | |
|---|---|---|
| $10 \leqq Fe \leqq 75$ | $5 \leqq Zr \leqq 15$ | $0 \leqq Hf \leqq 4$ |
| $10 \leqq Ni \leqq 60$ | $5 \leqq B \leqq 15$ | $0 \leqq Nb \leqq 4$ |
| $5 \leqq Cr \leqq 15$ | $0 \leqq Mo \leqq 12$ | $0 \leqq La \leqq 4$ |
| $0 \leqq Ti \leqq 10$ | | |

A more precise chemical analysis gave: $Fe_{51}$; $Ni_{18}$; $Cr_8$; $Zr_{10}$; $B_{12}$; $Mo_{0.3}$, $Si_{0.5}$; $Hf_{0.2}$.

This alloy had a fusion temperature ($Tf_0$), measured by an optical pyrometer, of 1100° C., and a hardness $Hv_{30}$ of 585.

Chemical analysis of another alloy gave: $Fe_{65}$; $Ni_{10}$; $Cr_5$; $Zr_8$; $B_{10}$; $Ti_{12}$. This alloy had a fusion temperature ($Tf_0$), measured by an optical pyrometer, of 1080° C., and a hardness $Hv_{30}$ of 870.

EXAMPLE 3: PREPARATION OF ALLOYS OF THE FAMILY (IV)

Alloys corresponding to the general formula of family (IV) were formed as bands in the same manner as used to obtain the alloys of the above examples.

The concentrations, in atomic %, of the chemical elements, were as follows:

| | | |
|---|---|---|
| $50 \leqq Co \leqq 82$ | $5 \leqq B \leqq 15$ | $5 \leqq Zr \leqq 15$ |
| $3 \leqq Ni \leqq 35$ | $0 \leqq Mo \leqq 12$ | |
| $5 \leqq Cr \leqq 15$ | $0 \leqq La \leqq 4$ | |

Chemical analysis of an alloy gave: $Co_{65}$; $Ni_{10}$; $Cr_5$; $Zr_{12}$; $B_8$. This alloy had a fusion temperature ($Tf_0$), measured by an optical pyrometer, of 1020° C., and a hardness $Hv_{30}$ of 550.

EXAMPLE 4: PREPARATION OF ALLOYS OF THE FAMILY (V)

Alloys corresponding to the general formula of family (V) were formed as bands in the same manner as used for obtaining the alloys of the above examples.

The concentrations, in atomic %, of the chemical elements, were as follows:

| | | | |
|---|---|---|---|
| $10 \leqq Fe \leqq 65$ | $5 \leqq Cr \leqq 15$ | | |
| $10 \leqq Co \leqq 65$ | $5 \leqq B \leqq 15$ | $5 \leqq Zr \leqq 15$ | |
| $10 \leqq Ni \leqq 65$ | $1 \leqq C \leqq 5$ | $0 \leqq Si \leqq 5$ | $1 \leqq P \leqq 9$ |

Chemical analysis of an alloy gave: $Fe_{36}$; $Co_{14}$; $Ni_{17}$; $Cr_{13}$; $Zr_7$; $B_7$; $C_3$; $Si_{0.3}$; $P_{2.7}$.

This alloy had a fusion temperature ($Tf_0$), measured by an optical pyrometer, of 1065° C., and a hardness $Hv_{30}$ of 685.

EXAMPLE 5: PREPARATION OF ALLOYS OF THE FAMILY (V)

Alloys corresponding to the general formula of family (V) were formed as bands in the same manner as used for obtaining the alloys of the above examples.

The concentrations, in atomic %, of chemical elements, were as follows:

| | | |
|---|---|---|
| $10 \leqq Fe \leqq 50$ | $5 \leqq Cr \leqq 15$ | $1 \leqq P \leqq 9$ |
| $10 \leqq Co \leqq 50$ | $5 \leqq B \leqq 15$ | $5 \leqq Zr \leqq 15$ |
| $10 \leqq Ni \leqq 50$ | $0 \leqq C \leqq 5$ | $0 \leqq Si \leqq 17$ |

Chemical analysis of an alloy gave: $Fe_{16}$; $Co_{16}$; $Ni_{20}$; $Cr_{10}$; $Zr_{10}$; $B_{14}$; $Si_{14}$. This alloy had a fusion temperature ($Tf_0$) of 1080° C. and a hardness $Hv_{30}$ of 1430.

EXAMPLE 6

The bands corresponding to the above-described compositions had a very high thermal stability as evidenced by their high values of the temperature of crystallization $T_{x1}$, which were, for example:

EXAMPLE 2—$T_{x1}$=545° C.

EXAMPLE 3—$T_{x1}$=570° C.

EXAMPLE 4—$T_{x1}$=560° C.

for a heating rate of 20° K./min.

Furthermore, the composition: $Fe_{20}$; $Co_{20}$; $Ni_{28}$; $Cr_{12}$; $Zr_{10}$; $B_{10}$, for example, was subjected to a thermal treatment of 3 hours at 400° C., and did not reveal any changes in its initial amorphous structure as determined by X-ray diffraction.

EXAMPLE 7—RESISTANCE TO CORROSION OF THE ALLOYS OBTAINED IN THE FORM OF BANDS

To characterize the corrosion resistance of the alloys, the following parameters were measured:

(1) Static and dynamic dissolving potential;

(2) resistance to polarization about the corrosion potential in the potentiodynamic mode and/or in the galvanodynamic mode; and (3) intensity of the corrosion current.

These three parameters were determined under the following conditions: $H_2SO_4$, 0.1 N; NaOH, 0.1 N; and NaCl, at a 3% concentration in water.

The results for the alloy: $Fe_{60}$; $Ni_{10}$; $Cr_{10}$; $Zr_8$; $B_{12}$, for example, were:

| | E corr (mV/ess) | E corr (dyn) | i corr (mA/cm) | RpK (ohm/cm$^3$) |
|---|---|---|---|---|
| $H_2SO_4$ (0.1N) | −556 | −674 | 0.69 | 303 |
| NaOH (0.1N) | −654 | −660 | 0 | 3465 |
| NaCl (3%) | −210 | −90 | 0 | |

EXAMPLE 8

The atomization of alloys of the general families (II) to (V) were carried out in an atomization tower having an aluminum-zirconium crucible and using an He-argon gas mixture; powders having grain sizes between 20 μm and 150 μm were obtained. For those grains having a size <100 μm, the examination of their structure, by X-ray diffraction (Cu-Kα line), revealed a completely amorphous structure.

For example, for a composition in wt.% of:

$Fe_{20.5}$; $Ni_{28.2}$; $Co_{20.9}$; $Zr_{16.2}$; $Cr_{11.4}$; $B_{2.4}$ the X-ray diffraction peak occurred in the range of from $35° \leqq 2\theta < 55°$. For example, a curve as shown in FIG. 1 was obtained for a registration speed of 4 minutes.

Figure 2:
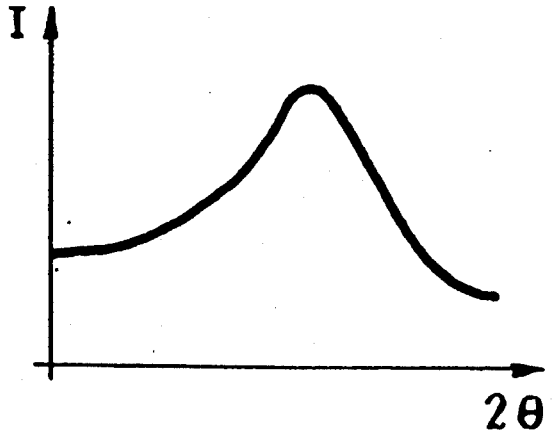

The curve in FIG. 2 shows the same registration of the X-ray diffraction for a composition in wt.% of:

$Fe_{54.2}$; $Ni_{17.4}$; $Zr_{17.2}$; $Cr_{11.6}$; $B_{2.27}$

EXAMPLE 9

The alloy powders of the families (II) to (V) were deposited on different metal substrates such as structural steel, stainless steel and copper-based alloys, by a thermal projection method and, for example, by the arc-blown plasma method under controlled atmospheric and temperature conditions.

The powders had a grain size of between 30 μm and 100 μm. The thicknesses, deposited on a sanded substrate, were between 0.03 mm and 1.5 mm. The covered surfaces were several square meters in size.

Figure 3:
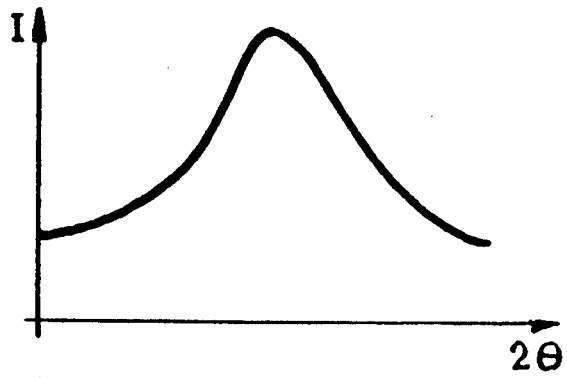
Figure 4:
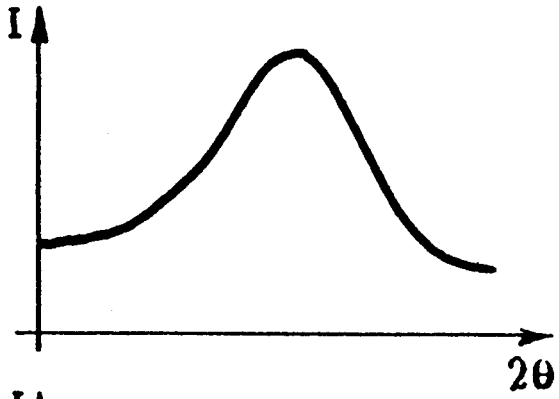
Figure 5:
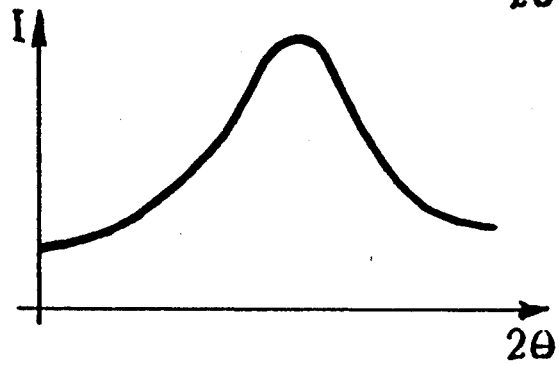
Figure 6:
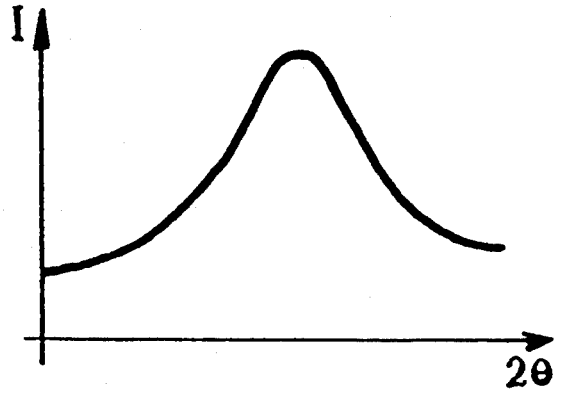
Figure 7:
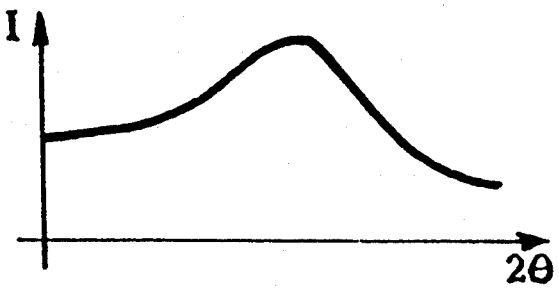

The X-ray diffraction patterns shown by the curves of FIG. 3 (thickness of 0.1 mm), FIG. 4 (thickness of 0.2 mm), FIG. 5 (thickness of 0.3 mm), FIG. 6 (thickness of 0.4 mm) and FIG. 7 (thickness of 0.5 mm), produced under the same conditions as those described in EXAMPLE 8, represent completely amorphous structures, in surface and in thickness, of the deposits.

These powder deposits can also be followed by a cryogenic cooling step under the conditions described, for example, in the document FR-A 83 07 135.

EXAMPLE 10

The deposits were made under the conditions described in EXAMPLE 9. However, in accordance with one embodiment of the method of the invention, instead of working under a controlled atmosphere to prevent the occurrence of any oxidation when the powders were projected during fusion, the single path of the particles being fused was protected by an annular nitrogen jet, directed concentric to the plasma jet conveying the particles, and sized only slightly larger in relation thereto. The deposits were applied under open air, under the partial protection of nitrogen.

For a very thick piece, the thermal mass of the piece can be sufficient to assure cooling, such that the deposit will have an amorphous structure. The cryogenic cooling step would not then be needed in such a case.

EXAMPLE 11—STUDY OF THE THERMAL STABILITY OF THE POWDERS AND DEPOSITS

Figure 8:
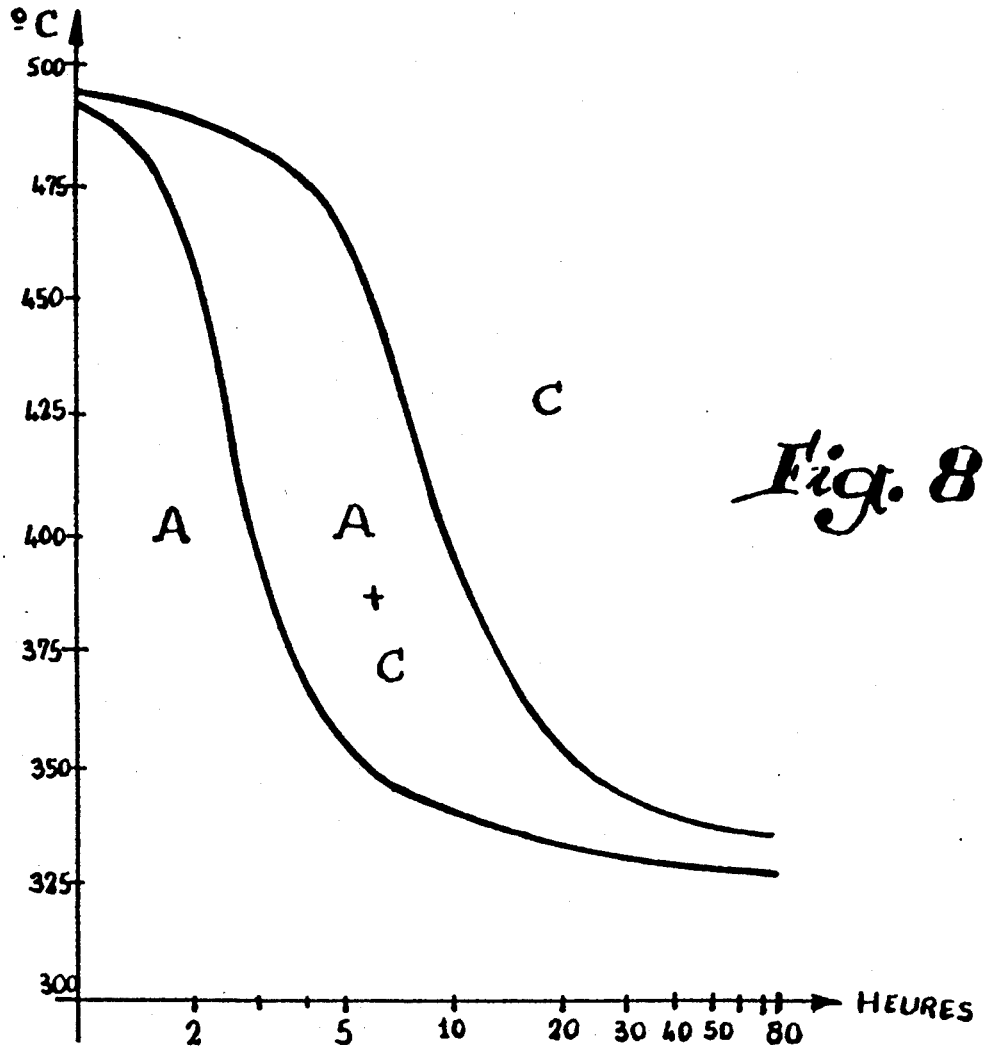
FIG. 8 is an isothermal annealing curve in which the abscissa represents the time (hours) and the ordinate represents the temperature (°C).

For the deposits corresponding to the chemical analyses of the alloy families (I) to (V), the isothermal and anisothermal annealings showed excellent thermal stability of the amorphous alloys. The curves shown in FIG. 8 correspond to a composition in at. % of: $Fe_{20}$; $Ni_{28}$; $Co_{20}$; $Cr_{12}$; $Zr_{10}$; $B_{10}$.

The following table gives the correlation between the at. % and the wt. % of the concentrations:

| | At. % | Atomic Mass | Mass of element in alloy | Wt. % |
|---|---|---|---|---|
| Fe | 20 | 56 | 1120 | 20 |
| Ni | 28 | 58.7 | 1643 | 29 |
| Co | 20 | 59 | 1180 | 21 |
| Cr | 12 | 52 | 624 | 11 |
| Zr | 10 | 91.2 | 912 | 16 |
| B | 10 | 10.8 | 108 | 2 |
| | | TOTAL = 5587 | | |

The isothermal annealings define the stability range of the amorphous (A) and crystallized (C) structures for a given time and temperature.

Figure 9:
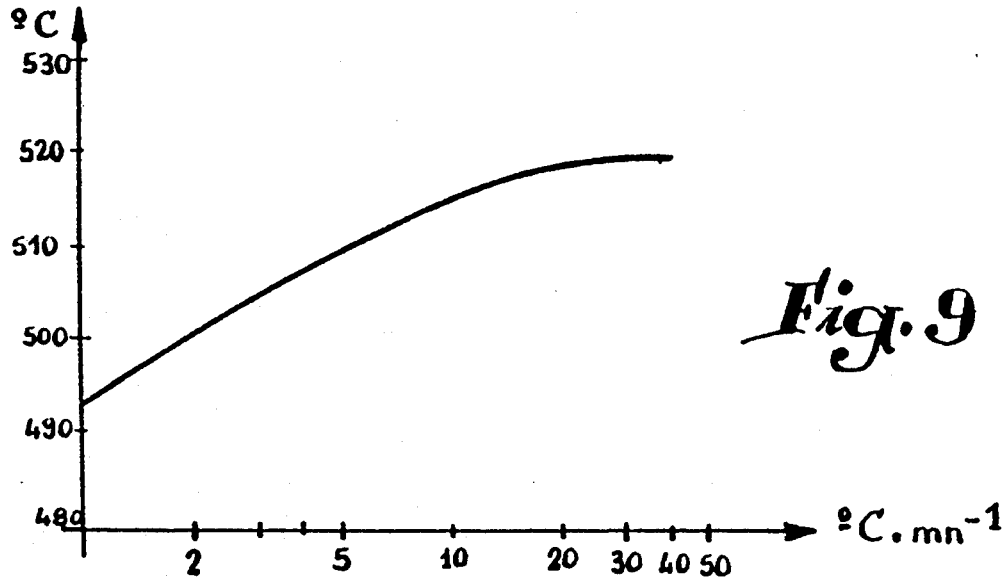
FIG. 9 is an isothermal annealing curve in which the abscissa represents the rate of heating (°C./min) and the ordinate represents the temperature at the start of crystallization (°C.).

The curve shown in FIG. 9 illustrates the results for the anisothermal annealings which define the start of the temperature of crystallization in relation to the rate of heating.

These results show the excellent thermal stability of the amorphous finishes up to very high temperatures, which is a very important advantage of the present invention.

EXAMPLE 12

The exceptional mechanical characteristics of the deposits obtained according to the present invention were determined, which relate to the hardness and ductility of the deposits.

For example, for the composition in at. % of: $Fe_{20}$; $Ni_{28}$; $Co_{20}$; $Cr_{12}$; $Zr_{10}$; $B_{10}$, "perfect disk" tests were carried out to measure the average coefficient of friction between the material and a diamond or aluminum indenter. A value of the coefficient of dry friction of 0.11 was obtained when the deposit was subjected to annealing for 3 hours at 400° C. The examination of the trace of the indenter in the deposit showed that, if there were cracks, they were of the type associated with ductile materials.

On a deposit having the same composition, but having a crystalline structure, the average coefficient of friction was higher by about 5%. Furthermore, it was found during the examination of the trace of the indenter, that the cracks were of the type associated with brittle materials.

These observations were confirmed by standard scoring testing in which, up to applied pressures in the range of the rupture limit of the materials, no evidence of cracking was detected.

EXAMPLE 13

Deposits having thicknesses of about 0.5 mm obtained by the thermal projection method of the present invention have, in the unfinished state of the deposits, a percentage of porosity in the range of 8% as measured by image treatment.

This porosity percentage can be reduced to almost zero by granulating the deposit from carbon steel or stainless steel balls having a diameter of between 1 mm and 1.6 mm for a fixed granulating intensity (Halmen of the Metal Improvement Company) from 16 to 18 and a recovery rate (metal improvement method) of 600%.

This result was confirmed by permeability testing of the deposit by the electrochemical method which showed, for severe corrosion conditions such as those noted above, the non-corrosion of the carbon steel used as a substrate for the deposit. The deposit was impermeable to the electrolyte.

EXAMPLE 14

The deposits were tested under wear conditions caused by abrasive erosion identical to those conditions occurring in hydraulic machine equipment operating in an aqueous surrounding containing fine particles of a solid material such as quartz.

Comparative tests were conducted with other materials under the following conditions:

(1) Tangential flow and also with a liquid/piece incidence angle of $<45°$;

(2) flow of velocity $\geqq 48$ m/s; and (3) quartz concentration of 20 g/l at a grain size of 200 μm.

The wear characteristics measured at an ambient temperature for the deposit were equivalent to ceramic wear characteristics such as, for example, $Cr_2O_3$, and were noticeably less than for the stellite-type metal alloys, duplex-type or martensitic-ferritic-type stainless steels, as well as commercial steels which are resistant to abrasion.

The dry abrasive erosion tests conducted for incidence angles ranging from 0° to 90° showed that the amorphous alloys of the present invention have better properties as compared to ceramics and other metal alloys.

Examination of the structures by X-ray diffraction showed that the deposits retained an amorphous structure after testing similar to their initial structure.

Finally, excellent results can also be obtained when the deposits are applied to non-metallic substrates such as wood, paper and synthetic substrates.

We claim:

1. A method for forming a metallic finish on a substrate, comprising the steps of:

providing a metallic alloy having an amorphous structure, said metallic alloy consisting essentially of the following formula:

$$T_aCr_bZr_cB_dM_eM'_fX_gI_h \quad (I)$$

wherein T is selected from the group consisting of Ni, Co and any combination of at least one of Ni and Co combined with Fe, and $3<a<70$ at. %;

M is one or more elements selected from the group consisting of Mn, Cu, V, Ti, Mo, Ru, Hf, Ta, W, Nb, Rh, and $0<e<12$ at. %;

M' is one or more elements selected from the group consisting of the rare earth elements and Y, and $0<f<4$at. %;

X is one or more elements selected from the group consisting of C, P, Ge and Si, and $0<g<17$ at. %;

I represents inevitable impurities and $h<1$ at. %;

$5\leqq b\leqq 25$ at. %;

$5 \leqq c \leqq 15$ at. %;

$5 \leqq d < 18$ at. %; and $a+b+c+d+e+f+g+h=100$ at. %;

providing a substrate; and depositing said metallic alloy on said substrate to form a finish having high resistance to wear by cavitation, abrasion, friction and scoring, and high resistance to corrosion.

2. The method of claim 1, wherein said metallic alloy is of the general formula:

$$Ni_aCr_bZr_cB_dM_eM'_fX_gI_h \quad \text{(II)}$$

wherein $a+b+c+d+e+f+g+h=100$ at. %; and

M, M', X, I represent the same elements as those for formula (I), and the percentages thereof being the same as in formula (I).

3. The method of claim 1, wherein said metallic alloy is of the general formula:

$$Ni_aFe_{a'}Cr_bZr_cB_dM_eM'_fX_gI_h \quad \text{(III)}$$

wherein $0 \leqq a+a' \leqq 70$ at. %, all of the other symbols have the same meaning as in formula (I), and said metallic alloy has a temperature of crystallization of about 545° C.

4. The method of claim 1, wherein said metallic alloy is of the general formula:

$$Ni_aCo_{a''}Cr_bZr_cB_dM_eM'_fX_gI_h \quad \text{(IV)}$$

wherein $0 \leqq a+a'' \leqq 70$ at. %, all of the other symbols have the same meaning as in formula (I), and said metallic alloy has a temperature of crystallization of about 570° C.

5. The method of claim 1, wherein said metallic alloy is of the general formula:

$$Ni_aFe_{a'}CO_{a''}Cr_bZr_cB_dM_eM'_fX_gI_h \quad \text{(V)}$$

wherein $0 \leqq a+a'+a'' \leqq 70$ at. %, all of the other symbols have the same meaning as in formula (I), and said metallic alloy has a temperature of crystallization of about 560° C.

6. The method of claim 1, wherein said metallic alloy has high resistance to wear and corrosion at temperatures up to about 400° C.

7. The method of claim 1, wherein said metallic alloy comprises a gas atomized powder having a grain size of from about 20 μm to about 150 μm.

8. The method of claim 7, wherein said powder is of a grain size of less than about 100 μm.

9. The method of claim 7, wherein said substrate is composed of metal.

10. The method of claim 9, wherein said powder is deposited on said substrate by an arc blown plasma process and said finish has a thickness of from about 0.03 mm to about 1.5 mm.

11. The method of claim 10, wherein the step of depositing comprises directing an annular nitrogen jet concentric to a plasma jet conveying molten metal particles so as to prevent oxidation of the particles.

12. The method of claim 10, wherein said powder is deposited on a substrate surface area greater than about 1 $m^2$.

13. The method of claim 10, further comprising the step of cryogenically cooling said finish.

14. The method of claim 10, further comprising the step of compacting said finish.

15. The method of claim 1, wherein said substrate is composed of a non-metallic material.

16. The method of claim 15, wherein said powder is deposited on said substrate by an arc blown plasma process and said finish has a thickness of from about 0.03 mm to about 1.5 mm.

17. The method of claim 15, further comprising the step of cryogenically cooling said finish.

18. The method of claim 16, wherein said powder is deposited on a substrate surface area greater than about 1 $m^2$.

19. A method for forming a metallic finish on hydraulic equipment, comprising the steps of:

providing a hydraulic equipment component having a surface;

providing a metallic alloy having an amorphous structure, said alloy consisting essentially of the following formula:

$$T_aCr_bZr_cB_dM_eM'_fX_gI_h \quad \text{(I)}$$

wherein T is selected from the group consisting of Ni, Co and any combination of at least one of Ni and Co combined with Fe, and $3<a<70$ at. %;

M is one or more elements selected from the group consisting of Mn, Cu, V, Ti, Mo, Ru, Hf, Ta, W, Nb, Rh, and $0<e<12$ at. %;

M' is one or more elements selected from the group consisting of the rare earth elements and Y, and $0<f<4$ at. %;

X is one or more elements selected from the group consisting of C, P, Ge and Si, and $0<g<17$ at. %;

I represents inevitable impurities and $h<1$ at. %;

$5 \leqq b \leqq 25$ at. %;

$5 \leqq c \leqq 15$ at. %;

$5 \leqq d < 18$ at. %; and $a+b+c+d+e+f+g+h=100$ at. %; and depositing said metallic alloy on said surface to form a finish having high resistance to wear by cavitation, abrasion, friction and scoring, and high resistance to corrosion, at temperatures up to about 400° C.

20. The method of claim 19, wherein said metallic alloy is of the general formula:

$$Ni_aCr_bZr_cB_dM_eM'_fX_gI_h \quad \text{(II)}$$

wherein $a+b+c+d+e+f+g+h=100$ at. %; and

M, M', X, I represent the same elements as in formula (I), and the percentages thereof being the same as in formula (I).

21. The method of claim 19, wherein said metallic alloy is of the general formula:

$$Ni_aFe_{a'}Cr_bZr_cB_dM_eM'_fX_gI_h \quad \text{(III)}$$

wherein $0 \leqq a+a' \leqq 70$ at. %, all of the other symbols have the same meaning as in formula (I), and said metallic alloy has a temperature of crystallization of about 545° C.

22. The method of claim 19, wherein said metallic alloy is of the general formula:

$$Ni_aCo_{a''}Cr_bZr_cB_dM_eM'_fX_gI_h \quad \text{(IV)}$$

wherein $0 \leqq a+a'' \leqq 70$ at. %, all of the other symbols have the same meaning as in formula (I), and said metallic alloy has a temperature of crystallization of about 570° C.

23. The method of claim 19, wherein said metallic alloy is of the general formula:

$$Ni_aFe_{a'}Co_{a''}Cr_bZr_cB_dM_eM'_fX_gI_h \quad (V)$$

wherein $0 \leqq a+a'+a'' \leqq 70$ at. %, all of the other symbols have the same meaning as in formula (I), and said metallic alloy has a temperature of crystallization of about 560° C.

24. The method of claim 19, wherein said hydraulic equipment component is a turbine.

25. The method of claim 19, wherein said metallic alloy comprises a gas atomized powder having a grain size of from about 20 μm to about 150 μm.

26. The method of claim 25, wherein said powder is of a grain size of less than about 100 μm.

27. The method of claim 25, wherein said powder is deposited on said substrate by an arc blown plasma process and said finish has a thickness of from about 0.03 mm to about 1.5 mm.

28. The method of claim 27, wherein the step of depositing comprises directing an annular nitrogen jet concentric to a plasma jet conveying molten metal particles so as to prevent oxidation of the particles.

29. The method of claim 27, wherein said powder is deposited on a substrate surface area greater than about 1 $m^2$.

* * * * *